US005183082A

United States Patent [19]

Baumann

[11] Patent Number: 5,183,082

[45] Date of Patent: Feb. 2, 1993

[54] FRAME STAVE FOR A HEDDLE FRAME

[75] Inventor: Hans Baumann, Horgen, Switzerland

[73] Assignee: Grob & Co. Aktiengesellschaft, Horgen, Switzerland

[21] Appl. No.: 798,109

[22] Filed: Nov. 26, 1991

[30] Foreign Application Priority Data

Jan. 19, 1991 [DE] Fed. Rep. of Germany ..... 4101512

[51] Int. Cl.[5] ..... D03C 9/06

[52] U.S. Cl. ..... 139/92

[58] Field of Search ..... 139/92, 91

[56] References Cited

U.S. PATENT DOCUMENTS

| | | | |
|---|---|---|---|
| 3,754,577 | 8/1973 | Heller | 139/92 |
| 4,387,742 | 6/1983 | Graf | 139/92 |
| 4,633,916 | 1/1987 | Rast | 139/92 |
| 4,901,767 | 2/1990 | Koch . | |

*Primary Examiner*—Andrew M. Falik
*Attorney, Agent, or Firm*—Watson, Cole, Grindle & Watson

[57] ABSTRACT

A frame stave includes a supporting bar designed as hollow body and adjoined by a supporting member for the heddle carrying rod. The supporting bar reaches its bending strength by a massive longitudinal bar of a substantially square cross-section which forms one of the narrow sides. The other narrow side is formed by the leg of an angeled supporting member for the heddle carrying rod. Two extremely thin walled sheet metal members are mounted preferably by a laser welding to the longitudinal bar and the leg and form the two broad sides. A filler body is located in the hollow inner space of the supporting bar which is for instance of a honeycomb like structure in which a plurality of individual hollow spaces or chambers are formed, which are filled by a sound attenuating material which remains elastic. Strips of material which are impregnated by a bonding agent close the filler body off at both sides and are bonded to the sheet metal parts. By this design the extremely thin sheet metal parts cannot buldge and the frame stave achieves a high stability and at the same time an optimal property regarding the sound altenuation due to the filler body with the sound altenuating material contained therein which remains elastic.

7 Claims, 1 Drawing Sheet

FRAME STAVE FOR A HEDDLE FRAME

BACKGROUND OF THE INVENTION

1. Field of the Invention

The invention relates to a frame stave for a heddle frame, including a supporting bar structured as a rectangular hollow body having two broad sides and two narrow sides, and including a heddle carrying rod extending at a distance from and parallel to one of the narrow sides, which heddle carrying rod is rigidly mounted to the supporting bar via a supporting member.

2. Description of the Prior Art

Generally known designs of heddle frames which consisted respectively of frame staves which are interconnected by side supports included frame staves consisting of light-metal hollow profiles at which the respective heddle carrying rod is formed thereonto in an integral manner. Because, however, today's weaving machines are to operate at continuously higher speeds and the longer the broader weaving machines are produced, the limits of the ability to take up loads of the extremely fast oscillatingly moved heddle frames are reached of which the frame staves which consist of light-metal profiles do not posess a sufficient alternating bending strength. Because the alternating bending strength of steel is substantially higher than that of light-metal it has also been proposed to use frame staves made of steel specifically for broad heddle frames in weaving machines operating at high speeds. These frame staves designed as a sandwich structure have, in order to reduce the weight quite thin-walled sheet metal parts at the broad sides and thicker longitudinal profiles at the narrow sides of a supporting bar which forms a hollow body and which, furthermore, carries the parallel extending heddle carrying rod at a metal connecting part.

Such a frame stave as disclosed in U.S. Pat. No. 4,901,767, commonly owned herewith, has a plurality of specifically flat and not deformed single parts which are assembled to a frame stave by a corresponding number of welding seams. This design has, however, various drawbacks. It is not only that to many welding seams are needed which renders to production more expensive whereby the necessary precision regarding the straightness of the frame stave to be produced can only be reached with difficulties because of the large number of welding seams, but also the thickness of the material of the thicker sheet metal parts which form the narrow sides of the supporting bar is not sufficient to guarantee a high alternating bending strength of the structure. Due to the oscillations when operating the heddle frame in the weaving machine the frame stave causes the generation of sound waves, but the sound attenuating effect of the foamed body which is contained in the hollow space of the supporting bar is minimal only.

SUMMARY OF THE INVENTION

Hence, it is a general object of the invention to provide a frame stave for a heddle frame which may be produced at lower costs and which can be adjusted easily by means of simple measures to meet the individual requirements of clients regarding the stiffness and weight of the frame stave and which due to its design is much better sound attenuated.

A further object is to provide a frame stave which comprises two thin walled sheet metal members which form the broad sides of the supporting bar; a massive longitudinal bar of a substantially square cross section forming one of the narrow sides and welded inbetween the two thin walled sheet metal members; a multiply angled profile bar forming the supporting member for the heddle carrying rod of which a leg forming the other of the narrow sides is also welded inbetween the two thin walled sheet metal members, which profile bar is of a sheet metal which is several times thicker than the sheet metal of the thin walled sheet metal members; and an integrally structured heddle carrying rod which is welded to a further leg of the profile bar. According to a preferred embodiment of the invention all metal parts of the frame stave are connected to each other by a laser welding. By means of the massive longitudinal bar of a substantially rectangular cross-sectional shape at the one narrow side of the supporting bar a high bending strength is reached whereby one advantage of this design consists in that it is possible to choose the cross-section of this longitudinal bar to be larger or smaller in order to therewith attain changes of the properties. It is not necessary to change or alter, resp. the gauges and auxiliary tools in order to produce frame staves of various different properties. It is also possible to have a longitudinal bar of which the cross-sectional profile grows in the direction towards half of the length or center, resp. thereof in order to produce a substantially stiffer frame stave without having to change its outer dimensions.

BRIEF DESCRIPTION OF THE DRAWINGS

The invention will be better understood and objects other than those set forth above, will became apparent when consideration is given to the following detailed description thereof when read in conjunction with the appended drawings wherein.

DETAILED DESCRIPTION OF THE PREFERRED EMBODIMENTS

Figure 1:
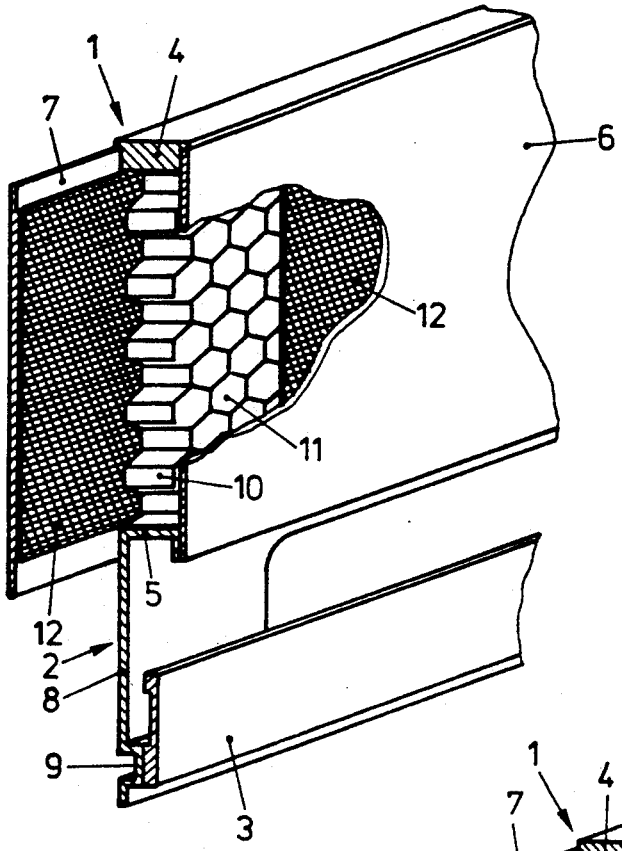
FIG. 1 is a perspective view of a vertical section through a frame stave with portions partly broken off.

The frame stave for a heddle frame as illustrated in FIG. 1 includes a supporting bar 1 structured as a hollow body and a supporting member 2 adjacent its bottom and which consists of a multiply angled profile bar to which the heddle carrying rod 3 is mounted which ex parallel to the supporting bar 1. The supporting bar 1 is formed by a massive longitudinal bar 4 having a substantially rectangular cross-section and forming the one narrow side thereof and by a leg 5 of the multiply angled profile rod forming the other narrow side, and by two thin walled sheet metal members 6 and 7 extending over the entire length of the frame stave and which are welded at the outside of the longitudinal bar 4 and of the supporting member 2. The connection is produced preferably by a laser welding.

The supporting member 2 is an integral structure consisting of sheet metal of a thickness of 0.7 millimeters to 1.25 millimeters having one of its legs 5 welded to the sheet metal members 6 and 7, and includes a longitudinally extending crimp located at a distance from its lower edge. An integrally formed heddle carrying rod 3 consisting preferably of a hardened steel is welded to the outside and from the inside of the crimp 9 which defines a further leg of the profile bar. The frame stave is completely manufactured by totally five welding seams. The four welding seams at the supporting bar are located in pairs opposite of each other, such that due to this symmetric arrangement the distortion which otherwise arises during the welding can be avoided whereby a high precision regarding the straightness of the frame stave can be arrived at. Because the heddle carrying rod 3 is welded on from its reverse side its front side remains completely even, such that the not illustrated weaving heddles can slide freely on the heddle carrying rod.

The depth of the crimp 9 can be selected during the production as desired to have different measures such that also a thinner heddle carrying rod is located at the correct place and it is possible to achieve therewith a further reduction of weight if such is desired when accepting a certain loss regarding the stiffness.

The supporting bar 1 encloses a hollow space which is filled by a filler body 10. According to FIG. 1 this body 10 is of a honeycomb structure having a plurality of individual hollow spaces or chambers, resp. 11 extending transversely therethrough. Every one of these individual hollow chambers 11 is filled by a noise attenuating material which remains elastic. It is here a soft foam which features good adhesive bonding properties. The filler body 10 with the honey-comb structure comprises now at the end surfaces facing the sheet metal members 6 and 7 only an extremely small surface which is suitable for an adhesive bonding to the sheet metal parts. Because the thickness of the sheet metal members 6 and 7 amounts to only 0.15 mm to 0.25 mm a bulging of the thin walled sheet metal members due to the weak supporting action of the honey-comb shaped filler body must be prevented by additional measures. For this reason a strip of material 12 is located at either side of the filler body 10 which strip which is impregnated by a bonding agent which can be activated for the bonding process and sets not earlier than thereafter. The strip of material consists of a fabric or a non woven felting and is impregnated by a bonding agent and is sold generally under the term "prepreg". The at both sides adhesive material strips 12 cause the extremely thin sheet metal members 6 and 7 to be bonded over the entire surface to the filler body 10 in order to prevent a bulging of these sheet metal members which is decisive regarding the stability of the entire frame stave. It is possible to select a material as material strip 12 which retains a high elasticity also after the setting of the bonding layer. It therewith is achieved that the thin sheet walled metal members 6 and 7 do not bulge but feature inspite thereof an excellent sound attenuation.

Figure 2:
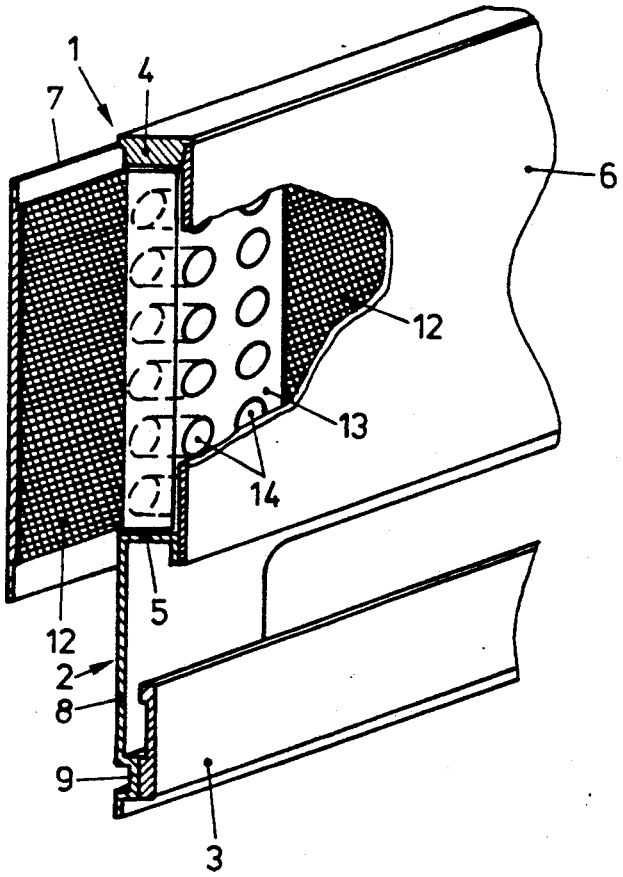
FIG. 2 a modified embodiment of the frame stave.

Instead of the honey-comb structure illustrated in FIG. 2 the filler body 10 can also be a hard foam 13 having a plurality of holes 14 extending transversely therethrough. These individual hollow chambers 14 are then also filled by a sound attenuating material which remains elastic.

By means of this sandwich structure consisting of five layers, including the two outer sheet metal members 6 and 7, the material strips 12 and filler body 10, excellent results regarding the rigidity of the frame stave have been reached. The disclosed frame stave includes specifically the advantages that it can be adjusted over a wide range to the specific requirements of the weaving operation by a structural changing of its individual components, such as for instance the cross-section of the longitudinal bar 4 or the thickness of the sheet metal 2 for the heddle carrying rod 3 or the depth of the crimp for the mounting of the heddle carrying rod, the cross-section of this heddle carrying rod, as well, and also the selection of the material for the filler body 10 at unchanged outer dimensions of the frame stave. In this way it is possible to produce for instance for very heavy fabrics or for very broad fabrics a frame stave of a high rigidity allowing an operation therewith due to the high rigidity without the often disturbing intermediate bracing. At the other hand, it is possible to produce for weaving machines operating at extremely high speeds a frame stave having a relatively light weight. It is, thereby, of a special advantage that it is possible to produce frame staves in which individual components were modified by the same productions means which allows a quite economic production.

While there are shown and described present preferred embodiments of the invention, it is to be distinctly understood that the invention is not limited thereto, but may be otherwise variously embodied and practiced within the scope of the following claims.

We claim:

1. A frame stave for a heddle frame assembly, including a rectangular hollow body having two broad sides and two narrow sides, and including a heddle carrying rod extending at a distance from and parallel to one of said narrow sides, which heddle carrying rod is rigidly mounted to said hollow body via a supporting member;

comprising two thin walled sheet metal members which form said broad sides of the hollow body;

a massive longitudinal bar of a substantially square cross section forming one of said narrow sides and welded inbetween said two thin walled sheet metal members;

a multiply angled profile bar forming the supporting member for said heddle carrying rod of which a leg forming the other of said narrow sides is also welded inbetween said two thin walled sheet metal members, which profile bar is of a sheet metal which is several times thicker than the sheet metal of said thin walled sheet metal members;

and said heddle carrying rod being integrally structured and welded to a further leg of said profile bar.

2. The frame stave of claim 1, comprising a filler body located in the hollow space formed by the hollow body, which filler body includes a plurality of individual hollow spaces extending transversely therethrough which individual hollow spaces are filled by a sound attenuating material which remains elastic.

3. The frame stave of claim 2, in which said filler body and said individual hollow spaces are covered at opposite sides by elastic strips of material equipped with adhesive bonding layers and which are bonded in turn to said sheet metal members forming the broad sides.

4. The frame stave of claim 3, in which the strip of material serving as the adhesive bond consists of a material which retains its elastic properties even after the adhesive bonding layers have set.

5. The frame stave of claim 2, in which said filler body consists of a hard foam which includes a plurality of through holes, or of a material having honey-comb shaped hollow chambers.

6. The frame stave of claim 1, in which all metal members of the frame stave are welded to each other.

7. The frame stave of claim 1, in which the leg of the heddle carrying rod which is connected to the profile bar includes a longitudinally extending crimp onto the outside surface of which the heddle carrying rod is welded from the inside of the crimp.

* * * * *